United States Patent [19]

Mitchell et al.

[11] 4,451,355

[45] May 29, 1984

[54] VANADIUM PASSIVATION IN A HYDROCARBON CATALYTIC CRACKING PROCESS

[75] Inventors: Bruce R. Mitchell, Lower Burrell; Roger F. Vogel, Jefferson Township, Butler County, both of Pa.

[73] Assignee: Gulf Research & Development Company, Pittsburgh, Pa.

[21] Appl. No.: 536,754

[22] Filed: Sep. 28, 1983

[51] Int. Cl.[3] ..... C10G 11/05; B01J 21/06; B01J 29/06

[52] U.S. Cl. ..... 208/113; 208/52 CT; 208/120; 502/60; 502/521; 502/525

[58] Field of Search ..... 208/52 CT, 120, 113; 502/521, 525

[56] References Cited

U.S. PATENT DOCUMENTS

| | | | |
|---|---|---|---|
| 2,258,787 | 10/1941 | Melaven et al. | 208/121 |
| 2,344,911 | 3/1944 | Young | 208/121 |
| 2,638,453 | 5/1953 | Starr, Jr. et al. | 208/52 CT |
| 2,886,513 | 5/1959 | Baker | 208/121 |
| 3,471,410 | 10/1969 | Oleck et al. | 502/521 |
| 3,546,094 | 12/1970 | Jaffe | 208/59 |
| 3,696,025 | 10/1972 | Chessmore et al. | 208/113 |
| 4,179,409 | 12/1979 | Gladrow et al. | 208/120 X |

*Primary Examiner*—Delbert E. Gantz
*Assistant Examiner*—O. Chaudhuri
*Attorney, Agent, or Firm*—Deane E. Keith; Forrest D. Stine

[57] ABSTRACT

Hydrocarbons containing vanadium are converted to lower boiling fractions employing a zeolitic cracking catalyst containing a significant concentration of a calcium-containing additive as a vanadium passivating agent.

8 Claims, No Drawings

VANADIUM PASSIVATION IN A HYDROCARBON CATALYTIC CRACKING PROCESS

FIELD OF INVENTION

This invention relates to an improved catalyst, the preparation, and a process for its use in the conversion of hydrocarbons to lower boiling fractions. More particularly, the invention is related to the use of a catalyst composition comprising a catalytically active crystalline aluminosilicate zeolite dispersed within a matrix containing a calcium-containing additive to passivate vanadium deposited on the catalyst during the conversion reaction.

BACKGROUND OF THE INVENTION

Crystalline aluminosilicate zeolites dispersed into a matrix of amorphous and/or amorphous/kaolin materials have been employed in the catalytic cracking of hydrocarbons for many years. The poisonous effects of metals contained in the feedstock when, for example, a gas oil is converted to gasoline range boiling fractions, in lowering catalyst activity and selectivity for gasoline production and in reducing catalyst life have been described in the literature.

Initially, these adverse effects were avoided or controlled by charging feedstocks boiling below about 1050° F. and having total metal concentrations below 1 ppm. As the need for charging heavier feedstocks having higher concentrations of metals increased, additives such as antimony, tin, barium, manganese and bismuth have been employed to mitigate the poisonous effects of metal contaminants nickel, vanadium and iron contained in the catalytic cracking process feedstocks. Reference is made to U.S. Pat. Nos. 3,711,422; 3,977,963; 4,101,417; and 4,377,494 as illustrative of such passivation procedures.

SUMMARY OF THE INVENTION

In accordance with the invention there is provided a catalyst comprising (1) a crystalline aluminosilicate zeolite, (2) a clay or synthetic inorganic refractory oxide matrix, and (3) an effective vanadium-passivating concentration of a calcium-containing additive.

Further, there is provided an improved process for the conversion of a vanadium-containing hydrocarbonaceous oil to lower boiling hydrocarbon products employing the above described catalyst.

DESCRIPTION OF THE PREFERRED EMBODIMENT

The catalyst composition of the present invention will comprise a crystalline aluminosilicate zeolite, a matrix material, and an effective vanadium-passivating concentration of a calcium-containing additive.

The crystalline aluminosilicate zeolite component of the present invention can be generally characterized as being a crystalline, three-dimensional, stable structure containing a large number of uniform openings or cavities interconnected by relatively uniform channels. The formula for the zeolites can be represented as follows:

$$XM_{2/n}O:Al_2O_3:1.5\text{-}6.5\ SiO_2:yH_2O$$

where M is a metal cation and n its valence; x varies from 0 to 1; and y is a function of the degree of dehydration and varies from 0 to 9. M is preferably a rare earth metal cation such as lanthanum, cerium, praseodymium, neodymium or mixtures thereof.

Zeolites which can be employed in the practice of this invention include both natural and synthetic zeolites. These natural occurring zeolites include gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, ferrierite, and the like. Suitable synthetic zeolites which can be employed in the inventive process include zeolites X, Y, A, L, ZK-4, B, E, F, H, J. M, Q, T, W, Z, alpha and beta, ZSM-types and omega. The effective pore size of synthetic zeolites are suitably between 6 and 15 A in diameter. The term "zeolites" as used herein contemplates not only aluminosilicates but substances in which the aluminum is replaced by gallium and substances in which the silicon is replaced by germanium or phosphorous and other zeolites such as ultrastable Y. The preferred zeolites are the synthetic faujasites of the types Y and X or mixtures thereof.

It is also well known in the art that to obtain good cracking activity the zeolites must be in good cracking form. In most cases this involves reducing the alkali metal content of the zeolite to as low a level as possible, as a high alkali metal content reduces the thermal structural stability, and the effective lifetime of the catalyst is impaired. Procedures for removing alkali metals and putting the zeolite in the proper form are known in the art.

The crystalline alkali metal aluminosilicate can be cation-exchanged by treatment with a solution essentially characterized by a pH in excess of about 4.5, preferably by a pH in excess of 5, and containing an ion capable of replacing the alkali metal and activating the catalyst. The alkali metal content of the finished catalyst should be less than about 1 and preferably less than about 0.5 percent by weight. The cation-exchange solution can be contacted with the crystalline aluminosilicate of uniform pore structure in the form of a fine powder, a compressed pellet, extruded pellet, spheroidal bead or other suitable particle shapes. Desirably, the zeolite comprises from about 3 to about 35, preferably from about 5 to about 25 weight percent of the total catalyst.

The zeolite is incorporated into a matrix. Suitable matrix materials include the naturally occurring clays, such as kaolin, halloysite and montmorillonite and inorganic oxide gels comprising amorphous catalytic inorganic oxides such as silica, silica-alumina, silica-zirconia, silica-magnesia, alumina-boria, alumina-titania, and the like, and mixtures thereof. Preferably the inorganic oxide gel is a silica-containing gel, more preferably the inorganic oxide gel is an amorphous silica-alumina component, such as a conventional silica-alumina cracking catalyst, several types and compositions of which are commercially available These materials are generally prepared as a co-gel of silica and alumina or as alumina precipitated on a pre-formed and pre-aged hydrogel. In general, silica is present as the major component in the catalytic solids present in such gels, being present in amounts ranging between about 55 and 100 weight percent, preferably the silica will be present in amounts ranging from about 70 to about 90 weight percent. The matrix component may suitably be present in the catalyst of the present invention in an amount ranging from about 55 to about 92 weight percent, preferably from about 60 to about 80 weight percent, based on the total catalyst.

A catalytically inert porous material may also be present in the finished catalyst. The term "catalytically inert" refers to a porous material having substantially no catalytic activity or less catalytic activity than the inorganic gel component or the clay component of the catalyst. The inert porous component can be an absorptive bulk material which has been pre-formed and placed in a physical form such that its surface area and pore structure are stabilized. When added to an impure inorganic gel containing considerable amounts of residual soluble salts, the salts will not alter the surface pore characteristics measurably, nor will they promote chemical attack on the pre-formed porous inert material. Suitable inert porous materials for use in the catalyst of the present invention include alumina, titania, silica, zirconia, magnesia, and mixtures thereof. The porous inert material, when used as a component of the catalyst of the present invention, is present in the finished catalyst in an amount ranging from about 10 to about 30 weight percent based on the total catalyst.

The calcium additive component of the catalyst of this invention is selected from the group comprising the multi-metallic calcium-titanium and calcium-zirconium oxides, the calcium-titanium-zirconium oxides and mixtures thereof. Suitable oxides are as follows:

$Ca_3Ti_2O_7$,
$Ca_4Ti_3O_{10}$,
$CaTiO_3$ (perovskite),
$CaTi_2O_5$,
$CaTi_4O_9$,
$CaTi_2O_4$,
$CaZrTi_2O_7$,
(Zr, Ca, Ti)$O_2$ tazheranite),
$CaZrO_3$,
$Ca_{0.15}Zr_{0.85}O_{1.85}$,
$CaZr_4O_9$.

The calcium-containing additive is a discrete component of the finished catalyst readily identifiable by X-ray diffraction analysis of the fresh catalyst and acts as a sink for vanadium during use in the cracking unit and thereby protects the active zeolite component.

When fresh hydrocarbon feed contacts catalyst in the cracking zone, cracking and coking reactions occur. At this time, vanadium is quantitatively deposited on the catalyst. Spent catalyst containing vanadium deposits passes from the cracking unit to the regenerator where temperatures normally in the range of 1150°–1400° F. (621° to 760° C.) are encountered in an oxygen-containing environment. Conditions are therefore suitable for vanadium migration to and reaction with the active zeolitic component of the catalyst. The reaction results in formation of mixed metal oxides containing vanadium which causes irreversible structural collapse of the crystalline zeolite. Upon degradation, active sites are destroyed and catalytic activity declines. Activity can be maintained only by adding large quantities of fresh catalyst at great expense to the refiner.

It is theorized that addition of the calcium-containing additive prevents the vanadium interaction with the zeolite by acting as a sink for vanadium. In the regenerator, vanadium present on the catalyst particles preferentially reacts with the calcium-containing passivator. Competitive reactors are occurring and the key for successful passivation is to utilize an additive with a significantly greater rate of reaction toward vanadium than that displayed by the zeolite. As a result, the vanadium is deprived of its mobility, and the zeolite is protected from attack and eventual collapse. It is believed that vanadium and the calcium-titanium and calcium-zirconium additives form one or more new binary oxides. The function of the titanium and zirconium is to prevent any interaction between the calcium and the zeolite which might damage the cracking performance of the catalyst. The overall result is greatly increased levels of permissible vanadium and lower fresh catalyst make-up rates. The concentration of the calcium additive in the catalyst of this invention will range from about 5 to about 40 weight percent based on the total catalyst.

A preferred calcium additive is a calcium titanate or calcium zirconate perovskite. Preferably, the concentration of the perovskite in the catalyst of this invention will range between 11 and 40 weight percent, more preferably between 12 and 20 weight percent of the total catalyst. For a description of the perovskite, reference is made to U.S. Pat. No. 4,208,269, which is incorporated herein by reference thereto. The $CaTiO_3$ perovskite can be prepared, for example, by firing calcium and titanium oxide at high temperatures (approximately 900°–1100° C.). In the preparation, equimolar amounts of calcium carbonate and titanium dioxide can be dry mixed and formed into 1-inch diameter pills prior to the firing step, which is conducted for a period of 15 hours.

The catalyst of the present invention can be prepared by any one of several conventional methods. One method comprises making an inorganic oxide hydrogel and separate aqueous slurries of the zeolite component, the calcium additive and if desired, the porous catalytically inert component, The slurries can then be blended into the hydrogel, and the mixture homogenized. The resulting homogeneous mixture can be spray-dried and washed free of extraneous soluble salts using, for example, a dilute ammonium sulfate solution and water. After filtering, the resulting catalyst is calcined to reduce the volatile content to less than 12 weight percent.

The catalyst composition of this invention is employed in the cracking of vanadium-containing charge stocks to produce gasoline and light distillate fractions from heavier hydrocarbon feedstocks. The charge stocks generally are those having an average boiling temperature above 600° F. (316° C.) and include materials such as gas oils, residuums and the like.

The charge stocks employed in the process of this invention can contain significantly higher concentrations of vanadium than those employed in the conventional catalytic cracking processes, as the catalyst of this invention is effective in cracking processes operated at vanadium contaminant levels in excess of 4,000 ppm, even exceeding 30,000 ppm. Thus, the charge stocks to the catalytic cracking process of this invention can contain vanadium contaminants up to 3.5 ppm and higher with no significant reduction in effective catalyst life when compared with conventional catalytic cracking processes wherein the concentration of vanadium contaminants in the charge stock is controlled at a level of less than 1.5 ppm.

Although not to be limited thereto, a preferred method of employing the catalyst of this invention is by fluid catalytic cracking using riser outlet temperatures between about 900° to about 1100° F. (482° to 593° C.). Under fluid catalytic cracking conditions, the cracking occurs in the presence of a fluidized composited catalyst in an elongated reactor tube commonly referred to as a riser. Generally, the riser has a length-to-diameter ratio of about 20, and the charge stock is passed through a preheater, which heats the charge stock to a temperature of at least 400° F. (204° C.). The heated charge stock is then introduced into the bottom of the riser.

In operation, a contact time (based on feed) of up to 15 seconds and catalyst-to-oil weight ratios of about 4:1 to about 15:1 are employed. Steam can be introduced into the oil inlet line to the riser and/or introduced independently to the bottom of the riser so as to assist in carrying regenerated catalyst upward through the riser.

The riser system at a pressure in the range of about 5 to about 50 psig (135 kPa to 446 kPa) is normally operated with catalyst and hydrocarbon feed flowing concurrently into and upward into the riser at about the same velocity, thereby avoiding any significant slippage of catalyst relative to hydrocarbon in the riser and avoiding formation of the catalyst bed in the reaction flowstream.

The catalyst containing metal contaminants and carbon is separated from the hydrocarbon product effluent withdrawn from the reactor and passed to regenerator. In the regenerator, the catalyst is heated to a temperature in the range of about 800° to about 1800° F. (427° to 982° C.), preferably 1150° to 1400° F. (621° to 760° C.) for a period of time ranging from three to thirty minutes in the presence of an oxygen-containing gas. This burning step is conducted so as to reduce the concentration of the carbon on the catalyst to less than 0.3 weight percent by conversion of the carbon to carbon oxide and carbon dioxide.

The following examples are presented to illustrate objectives and advantages of the invention. However, it is not intended that the invention should be limited to the specific embodiments presented therein.

EXAMPLE 1

The calcium-containing perovskite additive (calcium titanate) was prepared by separately screening calcium carbonate and titanium dioxide through 100 mesh. 24.2 grams of the screened calcium carbonate and 19.4 grams of the screened titanium dioxide were combined and rolled in a container for one hour. The powder was blended in a V-blender for three hours and thereafter formed into one-inch diameter cylinders using a die and a hydraulic press for one minute at 10,000 psig (69.0 MPa). The cylinders were calcined at 1000° C. for 24 hours, broken and sized through 100 mesh.

A catalyst composition was prepared by combining 70 weight halloysite, 15 weight percent of a rare earth exchanged Y zeolite, and 15 weight percent of the above-prepared calcium titanate and wet mixing in water for a period of time to provide a homogeneous mixture. The mixture was filtered and the cake dried for 24 hours at 120° C. The dried catalyst was sized through 100 mesh and heat shocked by heating the catalyst in a furnace for one hour at 1100° F. (593° C.).

In the preparation of a catalyst containing 15,000 ppm vanadium as a contaminant, 6.2828 grams of vanadium naphthenate containing 3.0 weight percent vanadium was dissolved in benzene to a total volume of 19 milliliters. 20.4 grams of the above-prepared catalyst was impregnated with the solution by incipient wetness and dried for twenty hours at 120° C. The catalyst was then calcined for 10 hours at 538° C. An additional 4.1885 grams of the vanadium naphthenate was dissolved in benzene to a total volume of 17 milliliters. The catalyst was impregnated with this solution and the drying and calcining steps repeated. The catalyst was then sized to 100–200 mesh.

The catalyst of this and subsequent examples were evaluated in a microactivity test unit. Prior to testing, the catalysts were steamed at 1350° F. (732° C.) for 14 hours at atmospheric pressure to simulate equilibrium surface area and activity. Catalytic cracking conditions were 960° F. (516° C.), a space velocity of 16.0 WHSV and a catalyst to oil ratio of 3.0. The gas oil feed to the reactor in this and subsequent examples was characterized as follows:

| | |
|---|---|
| Gravity, °API | 27.9 |
| Sulfur, wt % | 0.59 |
| Nitrogen, wt % | 0.09 |
| Carbon Residue, wt % | 0.33 |
| Aniline Point, °F. | 190.2 |
| Nickel, ppm | 0.3 |
| Vanadium, ppm | 0.3 |
| Vacuum Distillation, °F. | |
| 10% at 760 mm Hg | 595 |
| 30% at 760 mm Hg | 685 |
| 50% at 760 mm Hg | 765 |
| 70% at 760 mm Hg | 846 |
| 90% at 760 mm Hg | 939 |

The results obtained by employing a catalyst containing 15 weight percent calcium titanate and 15,000 ppm vanadium (Run 1) are shown below in Table I in comparison with the results obtained under the same conditions using a catalyst prepared as described above with the exception that the catalyst comprised 15 weight percent of a rare earth exchanged Y zeolite and 85 weight percent halloysite and contained 10,000 ppm vanadium as a contaminant (Run 2):

TABLE I

| | Run 1 | Run 2 |
|---|---|---|
| Conversion, Vol. % | 69.28 | 58.32 |
| Product yields, Vol. % | | |
| Total $C_3$ | 7.60 | 5.63 |
| Propane | 2.18 | 1.64 |
| Propylene | 5.43 | 3.99 |
| Total $C_4$ | 12.37 | 7.55 |
| I—butane | 5.71 | 2.43 |
| N—butane | 1.52 | 0.79 |
| Total butenes | 5.14 | 4.33 |
| $C_5$—430° F. Gaso | 54.14 | 38.43 |
| 430–650° F. LCGO | 21.01 | 27.16 |
| 650° F. + DO | 9.70 | 14.52 |
| $C_3$ + Liq. Rec. | 104.83 | 93.29 |
| FCC Gaso + Alk | 72.78 | 53.11 |
| Product Yields, wt % | | |
| $C_2$ and lighter | 2.50 | 3.53 |
| $H_2$ | 0.37 | 0.81 |
| $H_2S$ | 0.00 | 0.00 |
| Methane | 0.78 | 1.32 |
| Ethane | 0.71 | 0.82 |
| Ethylene | 0.63 | 0.58 |
| Carbon | 5.09 | 6.59 |

Comparison of the results demonstrates the effectiveness of calcium titanate to improve conversion (69.28 vs. 58.32) and to produce lower carbon and hydrogen yields even though the vanadium contaminant level was substantially higher (15,000 ppm vs. 10,000 ppm).

EXAMPLE 2

In this example the effectiveness of the calcium titanate additive to inhibit the effects of vanadium contamination at the higher contaminant levels of 25,000 ppm (Run 3) and 30,000 ppm (Run 4) is demonstrated. The catalysts and run conditions were as described in Example 1 with the exception of the vanadium contamination levels and the results are shown below in Table II:

TABLE II

| | Run 3 | Run 4 |
|---|---|---|
| Conversion, Vol. % | 66.41 | 65.99 |
| Product yields, Vol. % | | |
| Total $C_3$ | 6.75 | 5.98 |
| Propane | 1.19 | 0.80 |
| Propylene | 5.57 | 5.18 |
| Total $C_4$ | 12.09 | 11.12 |
| I—butane | 5.19 | 4.67 |
| N—butane | 1.27 | 1.05 |
| Total butenes | 5.64 | 5.39 |
| $C_5$—430° F. Gaso | 52.97 | 53.64 |
| 430-650° F. LCGO | 26.24 | 22.66 |
| 650° F. + DO | 7.36 | 11.36 |
| $C_3$ + Liq. Rec. | 105.40 | 104.75 |
| FCC Gaso + Alk | 72.73 | 72.30 |
| Product Yields, wt % | | |
| $C_2$ and lighter | 2.52 | 2.21 |
| $H_2$ | 0.42 | 0.35 |
| $H_2S$ | 0.00 | 0.00 |
| Methane | 0.76 | 0.64 |
| Ethane | 0.70 | 0.59 |
| Ethylene | 0.65 | 0.63 |
| Carbon | 4.78 | 4.05 |

A comparison of results obtained in Runs 3 and 4 with the results obtained in Run 2 demonstrate the effectiveness of the calcium titanate to increase conversion and lower carbon and hydrogen yields.

EXAMPLE 3

The criticality of employing a concentration of the calcium-containing additive of at least 5 weight percent is demonstrated by the results of Runs 5 and 6 in the following Table III where the concentration of calcium titanate in the catalyst was 3.0 and 7.5 weight percent, respectively. Other conditions to include a vanadium contaminant level of 15,000 ppm were as described in Example 1.

TABLE III

| | Run 5 | Run 6 |
|---|---|---|
| Conversion, Vol. % | 44.32 | 60.25 |
| Product yields, Vol. % | | |
| Total $C_3$ | 2.91 | 5.41 |
| Propane | 0.44 | 0.92 |
| Propylene | 2.47 | 4.48 |
| Total $C_4$ | 4.28 | 9.55 |
| I—butane | 1.26 | 3.74 |
| N—butane | 0.34 | 0.88 |
| Total butenes | 2.68 | 4.93 |
| $C_5$—430° F. Gaso | 34.71 | 49.72 |
| 430-650° F. LCGO | 33.73 | 27.41 |
| 650° F. + DO | 21.95 | 12.33 |
| $C_3$ + Liq. Rec. | 97.58 | 104.42 |
| FCC Gaso + Alk | 43.82 | 66.35 |
| Product Yields, wt % | | |
| $C_2$ and lighter | 2.04 | 2.27 |
| $H_2$ | 0.65 | 0.49 |
| $H_2S$ | 0.00 | 0.00 |
| Methane | 0.52 | 0.60 |
| Ethane | 0.47 | 0.61 |
| Ethylene | 0.40 | 0.57 |
| Carbon | 5.19 | 4.54 |

EXAMPLE 4

The use of the perovskite calcium zirconate, as the calcium-containing additive is demonstrated in this Example. In Run 7, the catalyst contained 10,000 ppm vanadium as a contaminant and was comprised of 7.0 weight percent of calcium zirconate prepared in accordance with the procedure for calcium titanate of Example 1, 15 weight percent of a rare earth exchanged Y zeolite and 78 weight percent halloysite. In Run 8, the catalyst, containing 10,000 ppm vanadium, was comprised of 15.0 weight percent of calcium zirconate, 15 weight percent of the rare earth exchanged Y zeolte and 70 weight percent halloysite. The run results are shown in Table IV.

TABLE IV

| | Run 7 | Run 8 |
|---|---|---|
| Conversion, Vol. % | 68.42 | 75.29 |
| Product yields, Vol. % | | |
| Total $C_3$ | 8.37 | 8.04 |
| Propane | 2.57 | 1.83 |
| Propylene | 5.80 | 6.21 |
| Total $C_4$ | 13.24 | 14.19 |
| I—butane | 5.99 | 6.87 |
| N—butane | 1.60 | 1.65 |
| Total butenes | 5.65 | 5.68 |
| $C_5$—430° F. Gaso | 50.07 | 61.10 |
| 430-650° F. LCGO | 21.47 | 17.76 |
| 650° F. + DO | 10.11 | 6.95 |
| $C_3$ + Liq. Rec. | 103.25 | 108.05 |
| FCC Gaso + Alk | 70.26 | 82.05 |
| Product Yields, wt % | | |
| $C_2$ and lighter | 2.71 | 2.08 |
| $H_2$ | 0.43 | 0.21 |
| $H_2S$ | 0.00 | 0.00 |
| Methane | 0.79 | 0.62 |
| Ethane | 0.76 | 0.61 |
| Ethylene | 0.73 | 0.64 |
| Carbon | 5.58 | 4.46 |

EXAMPLE 5

The uniqueness of the calcium-containing perovskite in passivating the poisonous effects of vanadium was demonstrated by attempting to substitute the lanthanum cobalt perovskite ($LaCoO_3$) for the calcium titanate perovskite. A catalyst containing 15,000 ppm vanadium and comprising 15.0 weight percent $LaCoO_3$, 15.0 weight percent rare earth exchanged Y zeolite, and 70 weight percent halloysite was prepared by the procedure of Example 1. The prepared catalyst was employed in a run (Run 9) utilizing the reaction conditions of Example 1, and the results are shown below.

TABLE V

| | Run 9 |
|---|---|
| Conversion, Vol. % | 55.26 |
| Product yields, Vol. % | |
| Total $C_3$ | 5.38 |
| Propane | 0.90 |
| Propylene | 4.48 |
| Total $C_4$ | 8.93 |
| I—butane | 3.50 |
| N—butane | 0.90 |
| Total butenes | 4.53 |
| $C_5$—430° F. Gaso | 42.76 |
| 430-650° F. LCGO | 28.71 |
| 650° F. + DO | 16.03 |
| $C_3$ + Liq. Rec. | 101.82 |
| FCC Gaso + Alk | 58.66 |
| Product Yields, wt % | |
| $C_2$ and lighter | 2.20 |
| $H_2$ | 0.45 |
| $H_2S$ | 0.00 |
| Methane | 0.63 |
| Ethane | 0.56 |
| Ethylene | 0.56 |
| Carbon | 5.99 |

A comparison of the results obtained in Runs 1 and 9 demonstrates that the use of $LaCoO_3$ results in an unacceptable conversion and high carbon production.

Obviously, modifications and variations of the invention, as hereinabove set forth, can be made without departing from the spirit and scope thereof, and therefore only such limitations should be imposed as are indicated in the appended claims.

We claim:

1. A process for the conversion of a hydrocarbon oil feed having a significant concentration of vanadium to lighter oil products which comprises contacting said feed under conversion conditions with a cracking catalyst containing a calcium-containing additive selected from the group consisting of calcium-titanium, calcium-zirconium, calcium-titanium-zirconium oxides and mixtures thereof.

2. The process of claim 1 wherein the concentration of vanadium in said feed is at least 1.5 ppm.

3. The process of claim 1 wherein the concentration of vanadium in said catalyst is at least 4000 ppm.

4. The process of claim 1 wherein the concentration of vanadium on said catalyst exceeds 30,000 ppm.

5. The process of claim 1 wherein said catalyst includes a catalytically inert porous material.

6. The process of claim 1 wherein said calcium-containing additive comprises a perovskite selected from the group consisting of calcium titanate and calcium zirconate and mixtures thereof.

7. The process of claim 6 wherein the concentration of said perovskite is in the range of 5 to 40 weight percent based on the total catalyst.

8. The process of claim 6 wherein the concentration of said perovskite is in the range of 11 to 40 weight percent based on the total catalyst.

* * * * *